US008117798B2

(12) United States Patent
Bergman

(10) Patent No.: US 8,117,798 B2
(45) Date of Patent: Feb. 21, 2012

(54) POST ANCHORING METHOD AND DEVICE

(76) Inventor: Richard Bergman, Ottawa, CA (US)

( * ) Notice: Subject to any disclaimer, the term of this patent is extended or adjusted under 35 U.S.C. 154(b) by 0 days.

(21) Appl. No.: 12/426,966

(22) Filed: Apr. 21, 2009

(65) Prior Publication Data

US 2009/0293410 A1 Dec. 3, 2009

Related U.S. Application Data

(63) Continuation of application No. 10/981,623, filed on Nov. 5, 2004, now abandoned.

(51) Int. Cl.
*E04B 5/00* (2006.01)
*E04B 9/00* (2006.01)
*E04F 13/04* (2006.01)

(52) U.S. Cl. ..... 52/745.17; 52/361; 52/376; 256/65.14; 403/283

(58) Field of Classification Search ..... 52/361, 52/40, 364, 831, 832, 155, 169.9, 301, 376, 52/745.17; 256/65.14, 65.01; 403/274, 276–283; 248/346.01, 519, 511, 539; 411/439, 487, 411/494, 479, 458; 473/492
See application file for complete search history.

(56) References Cited

U.S. PATENT DOCUMENTS 4,617,768 A * 10/1986 Gebelius ..... 52/40
5,176,344 A * 1/1993 Eberhard ..... 248/156
5,326,109 A * 7/1994 Robl ..... 473/492
5,722,205 A * 3/1998 Gannaway ..... 52/155
5,957,424 A * 9/1999 Krinner ..... 248/514
7,278,240 B2 * 10/2007 Burkart et al. ..... 52/155

* cited by examiner

*Primary Examiner* — Eileen D Lillis
*Assistant Examiner* — Andrew Triggs

(57) ABSTRACT

A post anchoring method for fence, deck, balcony and railing applications comprising providing an apparatus comprising a base member adapted to being attached to a surface and a tubular member that defines an inside surface, an outside surface and has a base end and a terminal end, and is at least twice as long as it is wide, wherein the base end is connected to the base member, and the terminal end defines an edge capable of piercing into the post; and carrying out the following steps in any order: attaching the base member to the surface; and aligning the post with the tubular member, abutting an end of the post to the terminal end and forcing the tubular member into the post to substantially impale the post such that the outside and inside surfaces frictionally engage the material of the post to secure the tubular member to the post.

11 Claims, 8 Drawing Sheets

POST ANCHORING METHOD AND DEVICE

BACKGROUND OF THE INVENTION

1. Field of the Invention

The invention relates to fastening methods and systems used for securing posts and the like to mounting surfaces and more particularly relates to post anchoring methods and devices for anchoring wood, fiber or other synthetic composite material posts used in fence, deck, balcony and railing applications to wooden, concrete, fiberglass, vinyl or other surfaces.

2. Description of the Prior Art

There is a need to provide a method and a mechanism by which posts can be secured to generally horizontal surfaces in such a way as to meet or exceed the functional requirements of strength and elimination of rot, and at the same time address aesthetic concerns surrounding the visibility and unsightly nature of the anchoring device and the fasteners used therein.

Strength of design is particularly important for an unsupported run of railing or fence posts that separate areas differing in elevation. Equally important is the need to ensure that the end of the post secured to the surface remains dry so that moisture cannot cause rot that will lead to the eventual degradation and destruction of the post.

Providing a solution to these functional and aesthetic concerns has thus far meant that one is achieved at the expense of the other. Superior strength has heretofore only been achieved with devices requiring a fully visible mechanism and fasteners attached to the exterior of the post. Alternatively, superior aesthetic solutions designed to conceal fasteners have heretofore possessed lower strength characteristics and often require unsightly supporting triangular brackets to stiffen the post to surface connection.

Known devices used to secure posts to concrete foundations, retaining walls and surfaces typically resemble a U shaped bracket with an anchoring appendage protruding from the underside of the bracket that is set into wet concrete. These brackets are painted to inhibit rust and require exterior fasteners to secure the post within it. These types of brackets are functional only and not aesthetically pleasing.

Other common forms of known post anchoring devices possess a square or rectangular metal tube with a molded, forged or welded base. The post fits into the tube and is secured by means of either horizontal fasteners through the sidewalls of the tube into the post, or a bracket, which tightens the circumference of the tube around the post. The base is then secured to the mounting surface with bolts or screws all of which are visible. While functional, these devices are not aesthetically appealing.

One known device that is designed to improve aesthetic appearance is a flat square shaped piece of sheet metal, the perimeter of which is slightly larger than the periphery of the cross section of the post. The metal base is fastened to the bottom of the post by screws or bolts passing through the underside of the base and remains concealed when the post is finally secured. The metal base, now attached to the bottom of the post, is then secured to the mounting surface by bolts or screws, through holes at the corners of the exposed periphery of the base, and remain visible.

This device is an aesthetic improvement from the previous devices. However, the corner fasteners are still visible and the strength of the entire union is dependent upon two factors; the holding power of the screw threads in the end grain of the post; and the shear strength of the screw when the post is subjected to lateral and leverage force.

In addition to the above devices, are a number of patented devices for securing posts to mounting surfaces. For example, U.S. Pat. No. 5,568,909 to Timko, U.S. Pat. No. 5,419,538 to Nicholas et al., U.S. Pat. No. 6,015,138 to Kohlberger et al. and U.S. Pat. No. 4,753,420 to Kaaria disclose devices which can be used to attach and secure posts to mounting surfaces.

Timko discloses a mounting bracket consisting of a square base attached to a square receiving tube similar to the known devices described earlier. The Timko device also has two drainage holes at the base of two opposing walls of the receiving tube. The post is placed in the receiving tube and fasteners are screwed, bolted or nailed through openings in the sidewalls and into the post. The base is bolted or screwed to the mounting surface at its corners. While the Timko device provides a stiff, secure union between post and mounting surface, it is attached to the outside of the post and has numerous visible fasteners that detract from the overall aesthetical appearance.

Nicholas discloses a post fastening system whereby the bottom of the post and the mounting surface must be bored in order to accept two separate discs with a threaded center aperture. The discs are screwed separately into the floor surface and the post. The center aperture receives a threaded stud and the post is then secured to the floor by screwing the exposed end of the threaded stud into the opposing disc. While the Nicholas device conceals the fasteners, boring is required in both the post and the floor surface. The system is designed primarily for newel posts used with interior railing systems. The mounting discs and stud are fitted very shallow into the opposing mating surfaces and therefore the union is not as strong as it would be if the stud were to protrude deeper into the post. It is also unsuitable for outdoor applications because the base of the post would be in direct contact with the mounting surface and subject to moisture and water damage.

Kohlberger discloses a newel post-anchoring device for securing newel posts to concrete and elevate the newel post above the surface to protect it from moisture. Although the device does conceal all fasteners, it is not suitable for mounting on to surfaces that are not as hard as concrete, such as wood, because the base is secured by a wedge bolt that must be placed into a hole bored into concrete or like material. The wedge bolt is specifically designed to provide maximum strength in concrete, thus confining the device's application.

Kaaria discloses a railing system, which includes a post anchor device designed to secure and elevate a wood post to a mounting surface without visible fasteners thereby providing superior aesthetics and keeping the wood from contacting water or moisture. The anchor device has a base plate through the center of which is fitted a lag screw from underneath and protruding vertically. The post is pre-drilled to accept the lag screw and is screwed down onto the plate. This device hides all fasteners, but without bracing, the unsupported newel posts are wobbly because the strength of the post to base connection is dependent upon the integrity of the narrow lag screw. The inherently narrow cross sectional dimensions of the lag screw necessarily means that it can never provide the degree of stiffness that is ultimately required for applications outside of a unitary railing system.

In order for exterior posts to withstand exposure to water and moisture, they should be elevated and not placed in direct contact with the mounting surface. Mounting surfaces may be concrete or the like, wood, fiber glass or other composite materials and therefore the ideal fastening mechanism ought to be suitable for each application. Furthermore, the ideal mechanism ought to hide all visible fasteners to maximize aesthetic appeal and yet still provide strength and stiffness so that a single post, or a plurality of posts forming a unitary run of railing or fencing, can stand without supporting brackets.

Accordingly, there is a need for a post anchoring device and method of using same which can be used on a diversity of mounting surfaces, provide greater structural rigidity and strength, minimize or eliminate exposure to moisture, have high aesthetic appeal by concealing the fastening apparatus, and be easy to install.

SUMMARY OF THE INVENTION

An apparatus for anchoring a post to a surface is provided comprising a base member capable of being connected to the surface, and an elongate tubular member having a base end and a terminal end, the base end being connected to the base member and the terminal end being remote from the base member such that the post may be impaled upon the tubular member by a user. In some embodiments, the walls of the tubular member at the terminal end are beveled to provide a cutting edge for cutting into the post to facilitate the impalement of the post. The tubular member is preferably cylindrical. In some embodiments, the base member is generally planar, having a first side which faces the surface when the apparatus is attached to the surface, and an opposite second side from which the tubular member extends. The base member may further include a peripheral flange extending away from the plane of the base in the same general direction as the tubular member, the flange having a peripheral edge that is capable of abutment with the end of the post as the post is driven upon the tubular member. In some embodiments, upon the abutment of the end of the post with the flange portion, the base member, flange portion and the bottom end of the post define a cavity in which fasteners or other hardware may be concealed from sight.

The present invention provides a method of anchoring a post to a flat solid surface in floor, patio, deck, railing or balcony applications, the method comprising the steps of: providing an apparatus comprising a base member adapted to being attached to the surface and a tubular member that defines an inside surface, an outside surface and has a base end and a terminal end, and is at least twice as long as it is wide, wherein the base end of the tubular member is connected to the base member and the terminal end is remote from the base member, and the terminal end defines an edge capable of piercing into the post; and carrying out steps (a) and (b) in any order: (a) attaching the base member of the apparatus to the surface at a location where the post is to be located; (b) longitudinally aligning the post with the tubular member, abutting an end of the post to the terminal end and forcing the tubular member into the post to substantially impale the post in a manner that all of the outside surface and all of the inside surface of the tubular member that is within a space defined by the external boundaries of the post are in frictional engagement with the material of the post to secure the tubular member to the post. In some embodiments, the method may further include selecting the tubular member and the post such that the ratio of the width or diameter of the post to the length of the tubular member is in the range of approximately 0.8:1 to 1.5:1 and the ratio of the width or diameter of the post to the diameter of the tubular member is in the range of approximately 2.4:1 to 5.5:1. In some embodiments, the method may further selecting the tubular member and the post such that the ratio of the width or diameter of the post to the length of the tubular member is approximately 1:1 and the ratio of the width or diameter of the post to the diameter of the tubular member is approximately 3.5:1.

The present invention further provides a method of anchoring a post to a flat solid surface in floor, patio, deck, railing or balcony applications, the method comprising the steps of: providing an apparatus comprising a base member adapted to of being attached to the surface and a tubular member that defines an inside surface, an outside surface and has a base end and a terminal end, and is at least twice as long as it is wide, wherein the base end of the tubular member is connected to the base member and the terminal end is remote from the base member, and the terminal end defines an edge capable of piercing into the post; providing a longitudinal cavity in one end of the post to accommodate the tubular member for a close frictional fit therein, the cavity having a depth that is less than the length of the tubular member; driving the post over the tubular member until the terminal end of the tubular member abuts the end of the cavity; and forcing the post onto the tubular member so that the tubular member substantially impales the post in a manner that all of the outside surface of the tubular member that is within a space defined by the external boundaries of the post, and a portion of the inside surface of the tubular member, are in frictional engagement with the material of the post to secure the tubular member to the post. In some embodiments, the depth of the cavity may be less than an intended penetration depth of the tubular member into the post. In some embodiments, the depth of the cavity is not greater than two-thirds of the length of the tubular member.

The present invention further provides a method of anchoring a post to a flat solid surface in floor, patio, deck, railing or balcony applications, the method comprising the steps of: providing an apparatus comprising a base member adapted to of being attached to the surface and a tubular member that defines an inside surface, an outside surface and has a base end and a terminal end, and is at least twice as long as it is wide, wherein the base end of the tubular member is connected to the base member and the terminal end is remote from the base member, and the terminal end defines an edge capable of piercing into the post; providing a circular cut of the same diameter as the tubular member in one end of the post to accommodate the tubular member therein, the circular cut having a depth that is less than the length of the tubular member; and carrying out steps (a) and (b) in any order: (a) attaching the base member of the apparatus to the surface at a location where the post is to be located; (b) aligning the circular cut of the post with the tubular member and sliding the post over the tubular member until the terminal end of the tubular member abuts the end of the circular cut, and then forcing the tubular member further into post to substantially impale the post in a manner that all of the outside surface of the tubular member that is within the post, and a portion of the inside surface of the tubular member, are in frictional engagement with the material of the post to secure the tubular member to the post. In some embodiments, the method may further include selecting the tubular member and the post such that the ratio of the width or diameter of the post to the length of the tubular member is in the range of approximately 0.8:1 to 1.5:1 and the ratio of the width or diameter of the post to the diameter of the tubular member is in the range of approximately 2.4:1 to 5.5:1. In some embodiments, the method may further include selecting the tubular member and the post such that the ratio of the width or diameter of the post to the length of the tubular member is approximately 1:1 and the ratio of the width or diameter of the post to the diameter of the tubular member is approximately 3.5:1. In some embodiments, the depth of the circular cut may be less than an intended penetration depth of the tubular member into the post. In some embodiments, the depth of the circular cut is not greater than two-thirds of the length of the tubular member.

The present invention further provides a system for mounting a post to a surface, the system comprising the post anchoring apparatus of the present invention and a post having a cavity at one end to accommodate the tubular member for a close fit therein, the cavity having a cavity length that is less than the length of the tubular member of the apparatus.

The use of a tubular member in the present invention creates a rigid and strong joint at the precise location where most of the leverage and lateral force against a post is concentrated. The tubular member also provides a large surface area for frictional engagement between its inner and outer walls and the material of the post, thereby generating significant holding power. This increased holding power and a more rigid union with the base provides an effective mechanism for mounting a post to a surface in an aesthetically pleasing manner so as to avoid the need for externally visible hardware by enabling the base and fasteners to be installed first and inside the outer periphery of the post walls. This characteristic allows the base to be sized smaller or larger, depending on preference, than the periphery of the post. The combination of the characteristics of this invention as described above offer a superior solution to addressing the challenge of maximizing strength and aesthetic value than prior art devices.

BRIEF DESCRIPTION OF THE DRAWINGS

Embodiments of the invention will now be described with reference to the accompanying drawings, in which:

in FIG. 3*a*, the device is shown positioned within the hole in the bottom of the prepared post; in FIG. 3*b*, the device is shown within the post once the post has been impaled over the device; in FIG. 3*c* the device is shown aligned with the bottom edge of an unprepared post; in FIG. 3*d* the device is shown partially within the post once the post has been partially impaled over the device; and in FIG. 3*e* the device is shown within the post once the post has been completely impaled over the device;

in FIG. 6*a*, the device is shown positioned within a hole in the bottom of the post; and in FIG. 6*b*, the device is shown within the post once the post has been impaled over the device;

DETAILED DESCRIPTION

Figure 2:
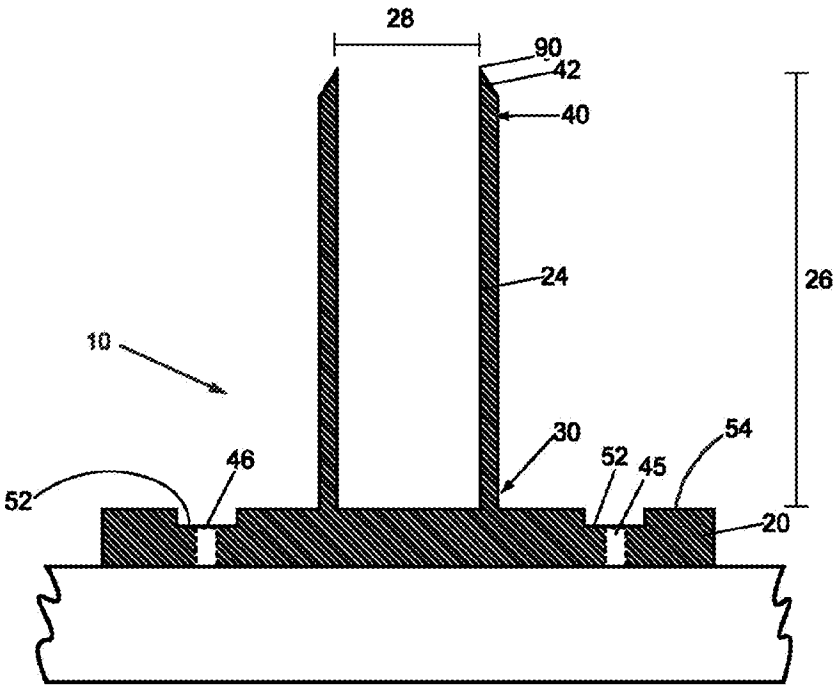
FIG. 2 is a center cross section of the device in FIG. 1 along line A-A.

Reference will now be made in detail to the present preferred embodiments of the invention, examples of which are illustrated in the accompanying drawings wherein like numerals indicate the same elements throughout the views. The invention disclosed herein may be practiced in embodiments in many different forms. Shown in the drawings and described herein are preferred embodiments of the present invention. However, it is understood that the present disclosure is an exemplification of the principles of the invention and does not limit the invention to the illustrated embodiments.

Figure 1:
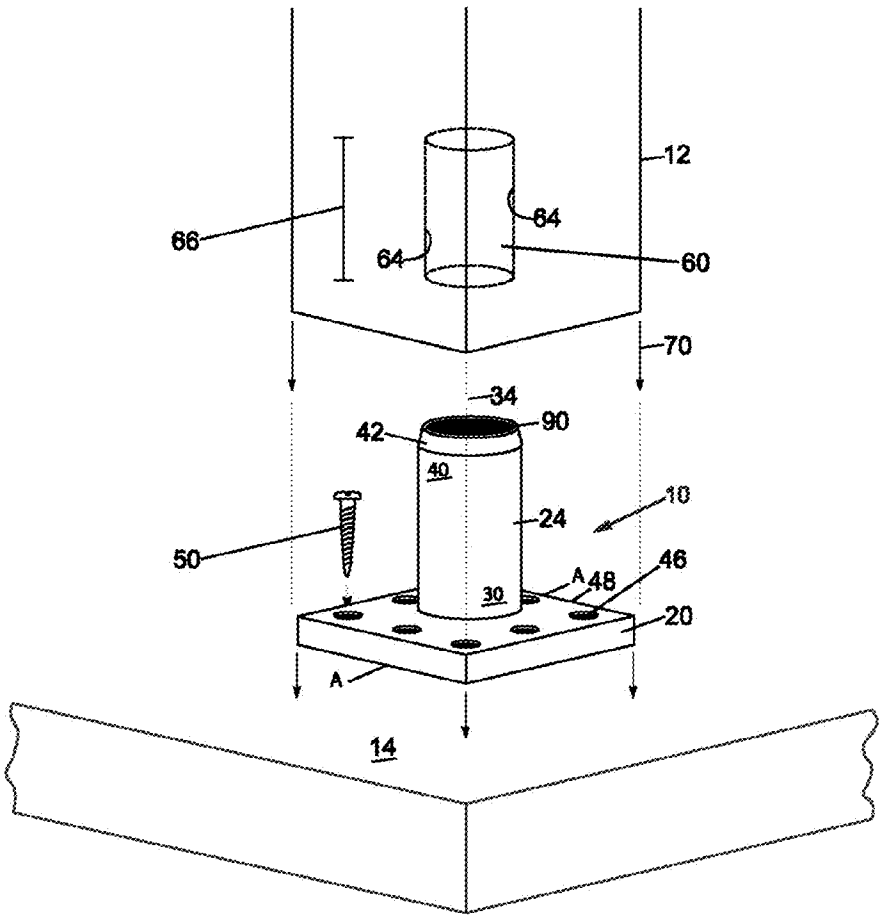
FIG. 1 is a perspective view of an embodiment of a post anchoring device shown in relation to a surface and a prepared post to be mounted on the surface.

Referring to FIGS. 1-3, there is depicted an embodiment of the present invention: a post anchoring device 10 for anchoring a post 12 to a surface 14. Device 10 comprises a planar base member 20 and an elongate tubular member 24 that is preferably cylindrical. As used herein, the word "tubular" means having the form or shape of a thin-walled hollow body. The tubular member is connected at a base end 30 to the base member. Preferably, longitudinal axis 34 of the tubular member is perpendicular to plane of the base member, although it is recognized that in some embodiments of the invention, the longitudinal axis of the tubular member may be at some other angle to the plane of the base member depending on the slope of the surface or the desired angle between the mounted post and the surface. The other or terminal end 40 of the tubular member is remote from the base member and has an exposed edge 42 capable of piercing the post. In order to facilitate the biting of the tubular member into the post as the post is impaled over the tubular member, as described herein, the exposed edge 42 is preferably beveled to provide a cutting edge 90

Base member 20 further comprises fastening means such as a plurality of holes 46 disposed proximate to base periphery 48. Holes 46 are adapted to receive fasteners there through, such as screws 50, for the mounting of device 10 to the surface. Preferably, each of the holes 46 comprises a chamfer or counter sunk bore 52 to enable the heads of the screws to be sunk below the top or second surface 54 of the base member upon the installation of the base member to the surface.

One of the more common post sizes in the industry is a 4" square post, which has an actual width (or diameter in the case of round posts) of approximately 3.5". In a post anchoring device for use with such posts, length 26 of the tubular member is preferably 3.5" and width 28 is preferably 1". The length 26 may be as low as approximately 2", but the strength of the hold between the tubular member and the post diminishes substantially in proportion to the decrease of the length 26. The length 26 may be longer than the preferable length, but the added benefit in terms of the strength of the hold diminishes as the length 26 increases considering that such increased length means that a greater force will be required to drive the post onto the anchoring device (which increases the risk of deforming the cutting edge, and if the top or remote end of the post is not protected, excessive force can damage it), as well as the increased material costs of manufacture. The width 28 of the tubular member may be smaller or larger than the preferred width. But if too large in proportion to the width of the post, then the remaining holding material 11 of the post may too thin and could fail relatively more quickly, thus compromising the strength of the hold between the tubular member and the post. And if the width is too small relative to the width of the post, then the strength of the hold between the tubular member and the post will be relatively less resistant to lateral forces. For posts of varying sizes, a ratio of the width or diameter of the post to the length 26 of the tubular member is preferably in the range of 0.8:1 to 1.5:1, and more preferably is approximately 1:1. And the ratio of the width or diameter of the post to the width 28 of the tubular member is preferably in the range of 2.4:1 to 5.5:1, and more preferably is approximately 3.5:1. Likewise, while these ratios are described as being preferable, the length 26 and/or the width 28 may be of varying sizes, and similar considerations as above are applicable.

Figure 3B:
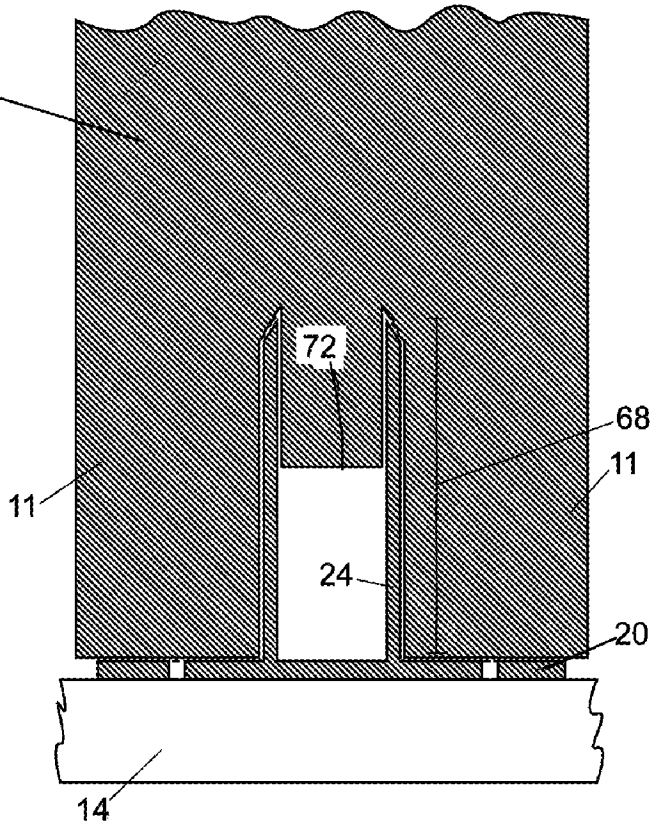
FIGS. 3*a*, 3*b*, 3*c*, 3*d*, and 3*e* are cross sections of the device in FIG. 1 along line A-A, as well as a bottom portion of a prepared post in the case of FIGS. 3*a* and 3*b*, and an unprepared post in the case of FIGS. 3*c*, 3*d* and 3*e*.
Figure 3A:
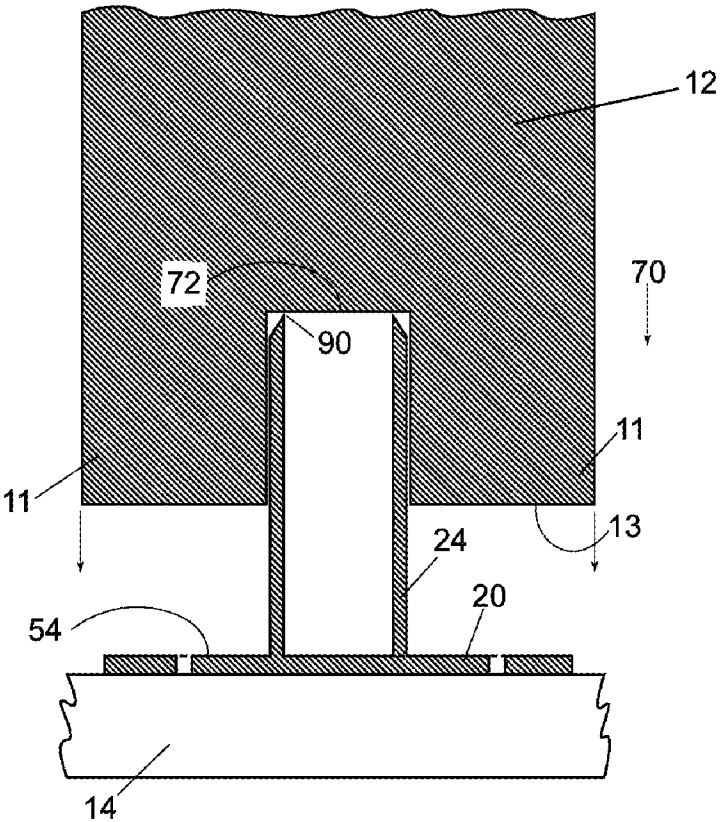

In operation, the post anchoring device is secured to the surface by the fasteners. The post that is to be anchored to the surface is preferably prepared by cutting or boring a cavity or hole 60 into one end to accommodate and guide the tubular member during installation. For example, the hole 60 may be bored using a Forstner bit preferably, or with a spade bit. The diameter of the hole is preferably equal to the outer diameter of the tubular member for frictional engagement between the tubular member and the inner walls 64 of the post. It is possible to use a hole saw of equal diameter to the tubular member and cut a kerf into the post. The depth 66 of the hole or kerf is preferably less than the length 26 of the tubular member, and in particular, is less than the penetration depth 68 of the tubular member for reasons that will be described shortly. A kerf is known in the art to mean a cut made by a saw or the like in a piece of wood. In the present instance, a hole saw (as stated above) is used to cut a circular kerf. Hole saws are well known and typically comprise of a metal cylinder, usually steel, mounted on an arbor adapted to being attached to a rotary drill or the like, and a cutting edge on the cylinder having saw teeth formed in it. A centering drill bit may or may not be present. An example of a hole saw is found in U.S. Pat. No. 4,072,441 to LaPointe. As such, the hole saw cuts a circular kerf into the post, having the same diameter as the tubular member, but leaves a core of the post material within the cut intact. Whenever the term "circular cut" is used herein, it refers to a circular kerf cut by a hole saw, or the like, which leaves a core of material intact within the boundaries of the circular kerf. Referring to FIGS. 3*a* and 3*b*, the hole 60 of the prepared post is then aligned with the tubular member and the post is fitted onto the tubular member with the application of an appropriate force in direction 70 until the cutting edge 90 of the tubular member abuts terminus 72 of the hole 60. Thus the hole aligns and guides the post onto the tubular member. The post is then forcibly driven or pounded further onto the tubular member by the application of a greater force in direction 70 such that the cutting edge 90 bites into the material of the post and the tubular member is impaled deeply into the post until the bottom end 13 of the post abuts the top surface 54 the base, as shown in FIG. 3*b*. The forcible impalement of the post results in a tight frictional engagement between the tubular member and the post, thereby securing or anchoring the post to the surface 14 in a manner such that the post is rigid and resistant to leverage upon it. While it is preferable to prepare the bottom of the post as described herein, it is possible to use an unprepared post and drive it onto the tubular member. However, greater effort will be required, and the absence of the guiding and aligning function of the hole will require greater effort in maintaining the post in longitudinal alignment with the tubular member as the post is being impaled upon the anchoring device.

Figure 3C:
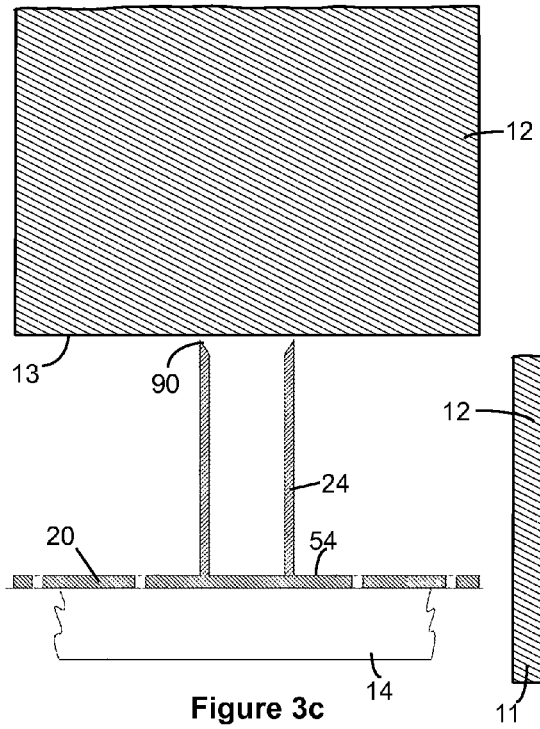
Figure 3D:
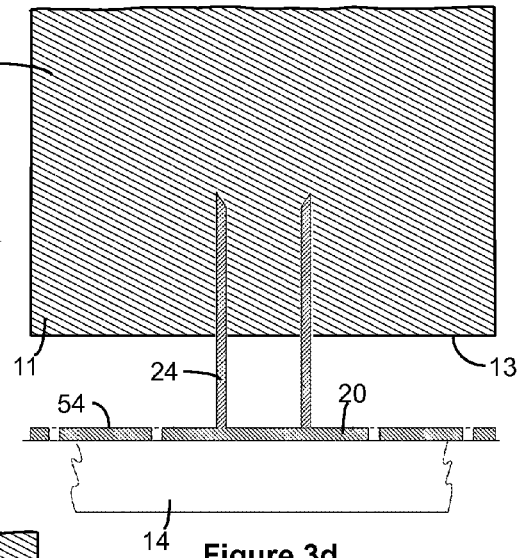
Figure 3E:
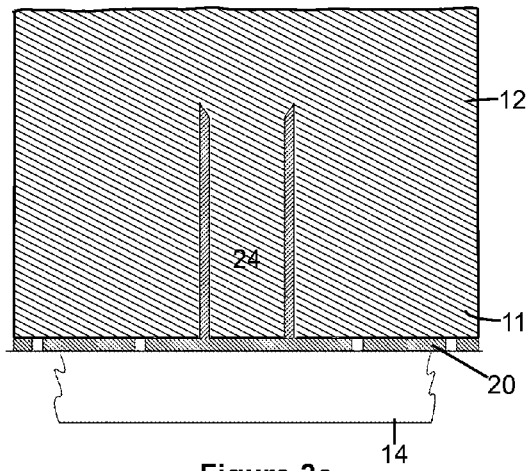

Referring to FIGS. 3*c*-3*e*, the unprepared bottom edge of post 12 is aligned with the tubular member 24 and the post is forcibly driven or pounded onto the tubular member with the application of an appropriate force on the post and/or the tubular member such that the cutting edge 90 bites into the material of the post and the tubular member is impaled deeply into the post (FIG. 3*d*) until the bottom end 13 of the post abuts the top surface 54 the base, as shown in FIG. 3*e*. The forcible impalement of the post results in a tight frictional engagement between the tubular member and the post, thereby securing or anchoring the post to the surface 14 in a manner such that the post is rigid and resistant to leverage upon it.

Depending on aesthetic preference, it may be desirable that the base member be shaped similarly to that of the post—be it square, rectangular, circular or otherwise. Also depending on aesthetic preference, it may be desirable that the dimensions of the base member be similar to or less than the cross sectional dimensions of the end of the post which is to be mounted on the anchoring device, such that the base is substantially concealed by the mounted post.

Figure 4:
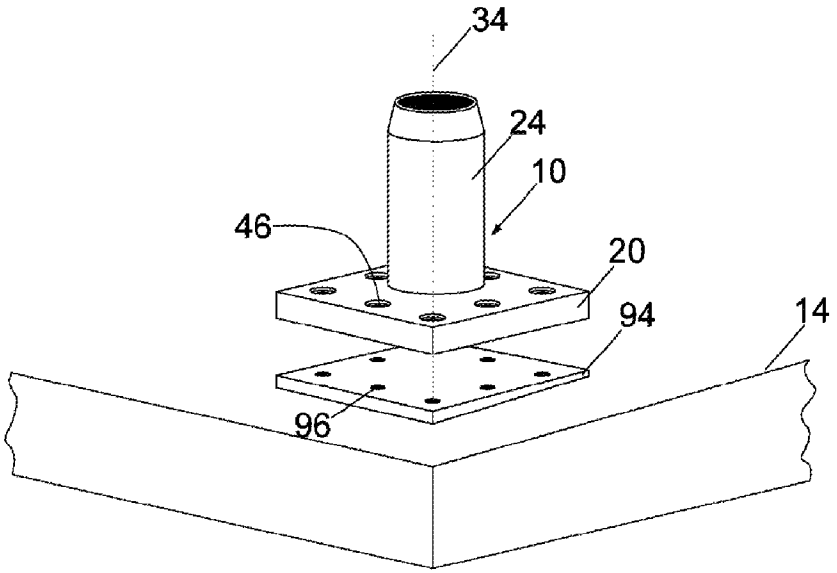
FIG. 4 is a perspective view of the device in FIG. 1 as used in conjunction with a shim member.

Referring to FIG. 4, if the surface 14 is sloped, for example to facilitate the flow of water from the surface, a wedge shaped gasket or shim member 94 may be placed between the base member 20 and the surface 14 to re-orient the anchoring device such that the longitudinal axis 34 of the tubular member 24 is vertical, or at any desired angle to the surface. Shim member 94 is provided with holes 96 which are in alignment with holes 46 in the base member when the base member is positioned on top of the shim member to accommodate the screws used to fasten the device to the surface.

The base member may be manufactured from plate steel, die case steel, aluminum or other suitable material, and the fastener holes may be machined into the base member. The tubular member may be metal tubing, such as steel or aluminum. The terminal end of the tubular member may be beveled to a single or two-sided cutting edge using a lathe or, preferably, using metal swaging techniques. The base end of the tubular member may be welded to a metal base member. The device can then be coated for corrosion protection using appropriate coating methods.

Figure 5:
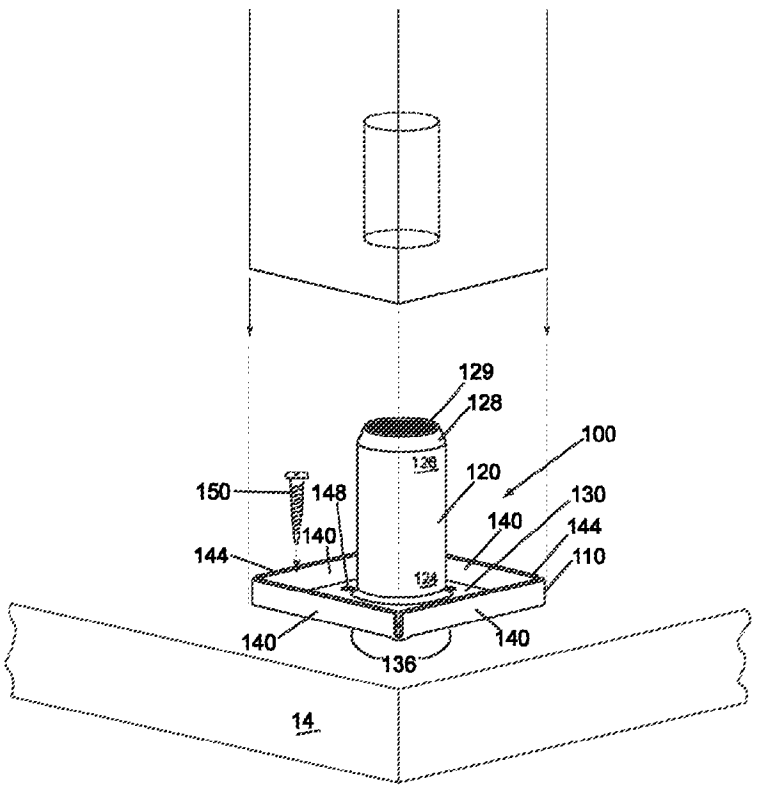
FIG. 5 is a perspective view of a further embodiment of a post anchoring device shown in relation to a surface and a prepared post to be mounted on the surface.

Referring to FIGS. 5-6, there is shown another embodiment of a post anchoring device. Device 100 comprises a base member 110 and an elongate tubular member 120 similar to that described above. The tubular member is connected at base end 124 to the base member. The other or terminal end 126 of the tubular member is remote from the base member and has an exposed edge 128 which is preferably beveled into a cutting edge 129 as described above.

Base member 110 comprises a planar member 130 and flange portions or portion 140 originating along periphery 136 of the planar member and extending away from the planar member such that when the base member is mounted on the surface, the flange portion extends away from the surface. Flange portion 140 terminates in flange edge 144 which is elevated above the mounting surface when the anchoring device is secured to the mounting surface. The planar member 130 further comprises fastening means such as a plurality of holes 148 disposed proximate to periphery 136 for receiving fasteners such as screws 150 there through for the mounting of device 100 to the surface.

To achieve a relatively low cost of manufacture, the base member 110 may be cut or stamped from sheet metal such that the flange portion 140 may be pressed upward to form the solid ridge or flange edge 144 around the periphery of the base. The tubular member 120 may be welded to the base.

Figure 6B:
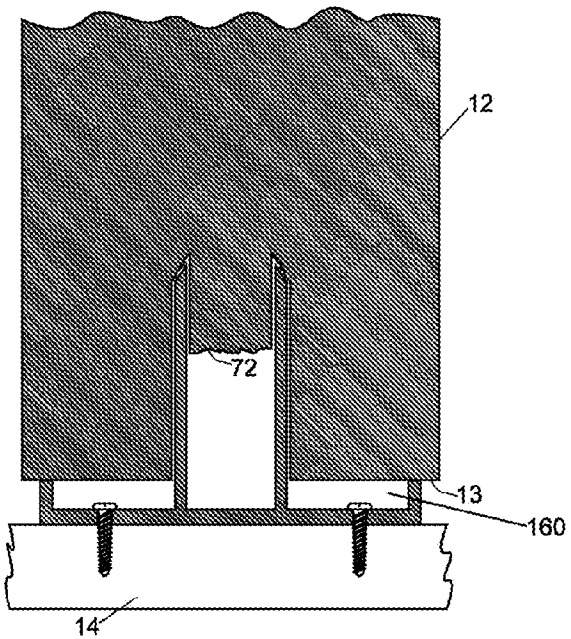
FIGS. 6*a* and 6*b* are center cross sections of the device in FIG. 5, as well as a bottom portion of a prepared post.
Figure 6A:
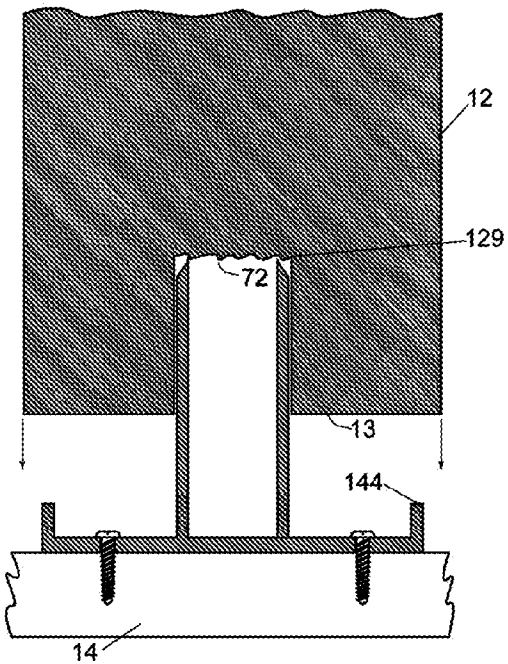

In the installation and anchoring of the post, the post anchoring device is secured to the surface by the fasteners and the post is prepared at one end as previously described herein. Referring to FIGS. 6*a* and 6*b*, the post 12 is fitted onto the tubular member until the cutting edge 129 of the tubular member abuts the terminus 72 of the hole, and then the post is forcibly driven further onto the tubular member such that the cutting edge 129 bites into the material of the post and the tubular member is impaled deeply into the post until the bottom end 13 of the post abuts the flange edge 144. An internal cavity 160 is thereby defined by the planar member, the flange portion and the bottom edge of the post within which the fasteners are hidden from view. The result is a complete concealment of the fastening means. Furthermore, the end of the post is elevated from the mounting surface and remains relatively free of surface moisture.

Preferably, the peripheral dimensions of the base member, particularly the flange edge is equal to or less than the cross-sectional dimension of the mounting end of the post, thereby allowing the transverse bottom surface of the post to rest on the upright flange edge 144 and the post walls to extend beyond the periphery of the base when engaged with the device to facilitate the draining of rainwater off the sides of the post and for aesthetic preference. The outer periphery of the walls of the post being greater than the periphery of the base allow for water to drain directly to the mounting surface with no pooling around the bottom edge of the post where the end grain is more likely to absorb surface water.

Figure 7:
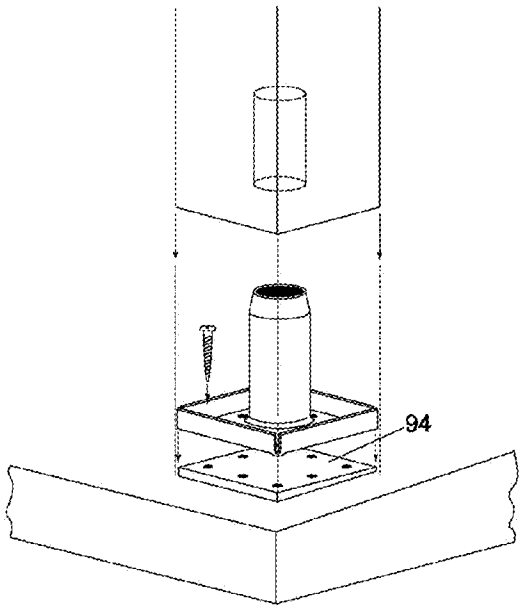
FIG. 7 is a perspective view of the device in FIG. 5 as used in conjunction with a shim member.

Also, as described above in the case of a sloped surface, a gasket or shim member 94, as shown in FIG. 7, may be used between the base member and the surface to re-orient the longitudinal axis of the tubular member to a desired angle.

The base member 110 is preferably sheet metal that is cut or die punched. The sheet metal is cut in such a way that it can be placed on a breaking tool or a custom press so that flanges can be pressed to a generally perpendicular attitude relative to the base. The tubular member is then welded to the base. This method of manufacture is relatively inexpensive, requiring little tooling costs and the resultant device is strong. The device can then be coated for corrosion protection using appropriate coating methods.

Figure 8A:
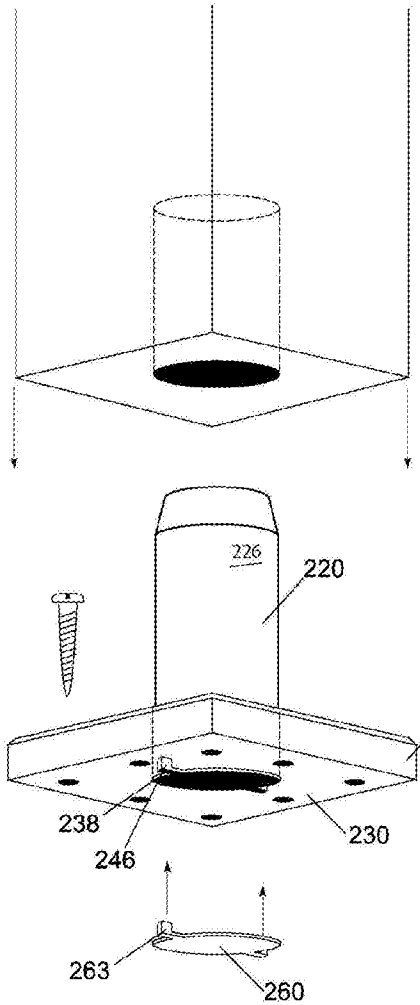
FIG. 8*a* is a perspective view of a further embodiment of a post anchoring device shown in relation to a prepared post to be mounted.
Figure 8B:
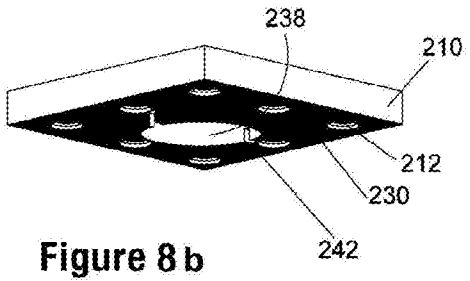
FIG. 8*b* is a perspective view from the bottom of an embodiment of the base member of the device in FIG. 8*a;*
Figure 9:
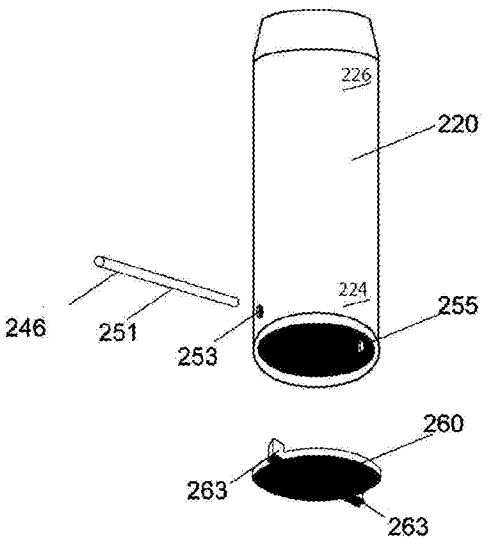
FIG. 9 is an exploded perspective view of an embodiment of a tubular member of the device in FIG. 8.
Figure 10:
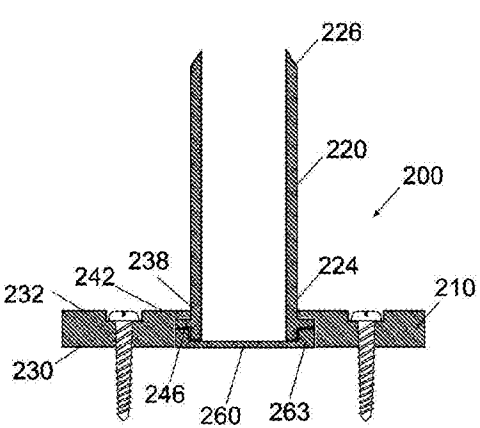
FIG. 10 is a center cross section of the device in FIG. 8.

Referring now to FIGS. 8-10, there is shown another embodiment of the present invention. Post anchoring device 200 comprises a base member 210 having a plurality of holes 212 (preferably countersunk) to accommodate screws, and an elongate tubular member 220 having a base end 224 and a terminal or cutting end 226. The device has connector means to enable the tubular member to be connected to the base member as described: base member 210 comprises a surface contact or first side 230 and an opposite second or top side 232, and has a central bore 238 of slightly larger diameter as the external diameter of the tubular member thereby allowing the tubular member to be slid therethrough. On the surface mounting side 230 of the base member and around the periphery of the bore 238 is provided at least one slot 242 that extends partially through the thickness of the base member but does not communicate with the top side 232. In other words, there is at least one slot around the bore periphery on the surface contact side of the base member that does not pierce through to the top side of the base member.

The base end 224 of the tubular member 220 includes at least one protrusion 246 that correspond with the slot or slots 242, and having a shape that is complimentary to the corresponding slot(s) for a snug friction fit therein. As exemplified in FIG. 9, the protrusion 246 may comprise a rod 251, that is slightly longer than the external width of the tubular member, being passed through diametrically opposed holes 253 and 255 in the tubular member such that the ends of the rod 251 extend beyond the tubular member. Alternatively, protrusion (s) 246 may be otherwise formed on the base end 224 of the tubular member. Accordingly, the tubular member is capable of being connected with the base member by being passed through the base member from the surface contact side, beginning with the tubular member's terminal end, until the protrusion or protrusions at the base end of the tubular member are engaged by the corresponding slot or slots in the base member, thereby preventing the tubular member from passing completely through the base member, and also limiting rotation of the tubular member about its longitudinal axis relative to the base member. Preferably, there is also provided a resilient end cap 260 having corresponding protrusions 263 that fit within the slot or slots 242. End cap 260 is dimensioned to fit within the hole 238 and over the base of the tubular member as shown in FIGS. 8*a* and 10, wherein the protrusions 263 slide into the slots 242 behind the protrusions 246 of the tubular member. Thereby end cap 260 locks the tubular member in place and evenly distributes forces from the tubular member to the surface thereby reducing wear or damage to the surface.

In using the above embodiment of the post-anchoring device, the method of installation is as follows. The tubular member 220 is fitted through the aperture from the bottom of the base. The protruding members 246 are fitted into the slot or slots 242 and the end cap or plug 260 is fitted over the base end of the tube. The base 210 is then secured to the mounting surface with screws. If the mounting surface is sloped to assist water egress, a shim gasket as described above may be installed between the base and the surface to adjust the attitude of the tubular member to a desired angle relative to the surface. The bottom of a post is prepared as described above, and the post is then impaled over the tube as above. The base member 210 may be made of metal, plastic or fiberglass. The tubular member 220 is preferably metal.

Figure 11:
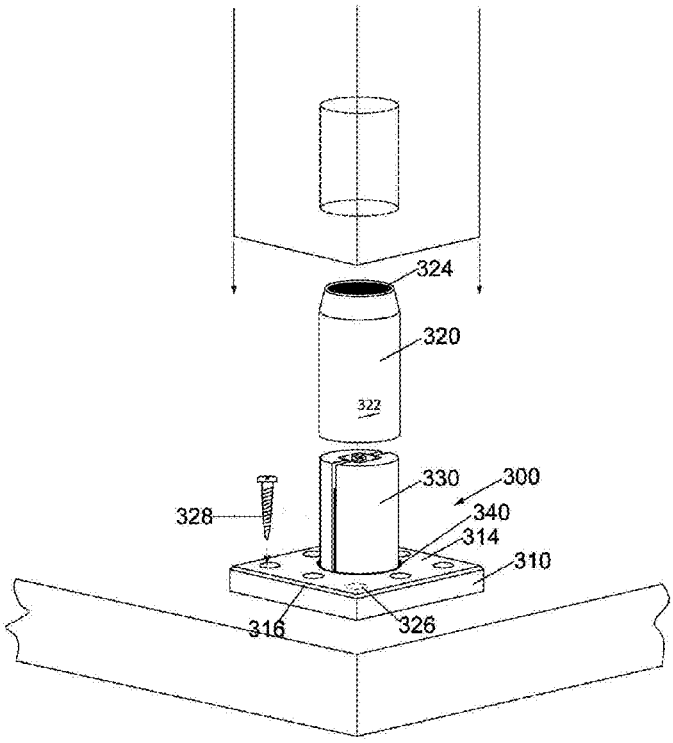
FIG. 11 is a perspective view of a further embodiment of a post anchoring device shown in relation to a surface and a prepared post to be mounted.
Figure 12:
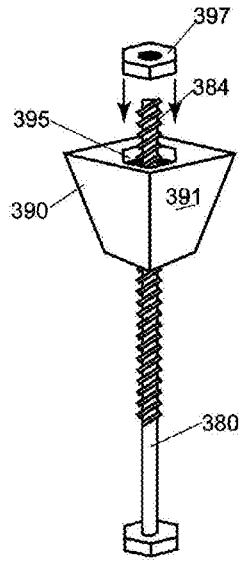
FIG. 12 is a perspective view of an embodiment of a cam member and bolt configuration of the device in FIG. 11.
Figure 13:
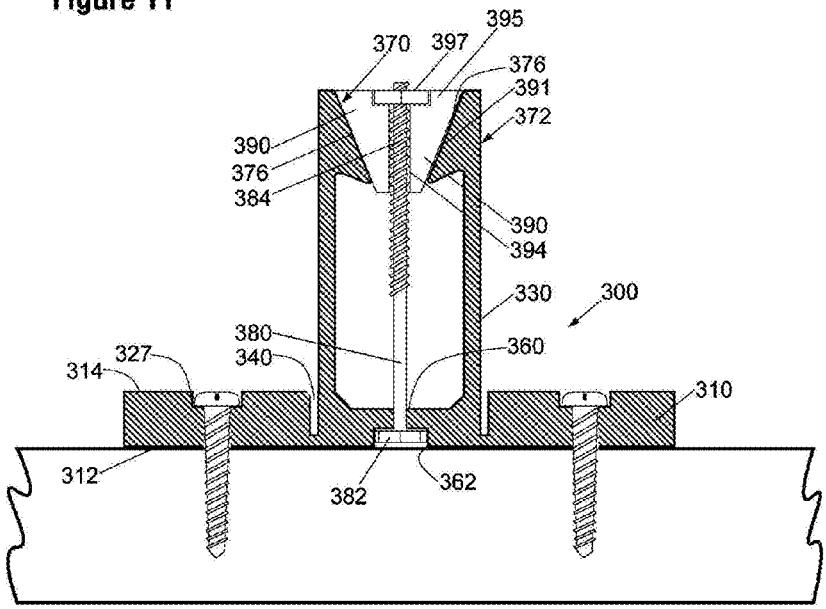
FIG. 13 is a center cross section of the device in FIG. 11.

Referring now to FIGS. 11-13, there is shown another embodiment of the present invention. Post anchor device 300 generally comprises a base member or base 310 and an elongate tubular member or tube 320 having base end 322 and a cutting edge 324. The base has a first or bottom side 312 and a second or top side 314, and further includes fastening means such as a plurality of holes 326 disposed proximate to periphery 316 for receiving fasteners, such as screws 328 there through for the mounting of device 300 to the surface. The base further includes a split tubular portion or split portion 330 extending generally perpendicularly from the top side 314. A circumferential channel 340 is provided around the circumference of the split tube 330 on the top surface of the base. Outer diameter of the split tube in a relaxed state is equal to, or slightly less than, inner diameter of the tube 320 such that the base end 322 of the tube may be slid over the split tube 330. The diameter of the channel 340 is equal to the diameter of the base end of the tube 322 such that the channel is able to receive the base end as the tube is slid onto the split tube. Located centrally relative to the split tube is hole 360 that passes through the base. On the bottom surface of the base located coaxially with the hole 360 is a partial bore 362 having a larger diameter than the hole. Inner surface 370 at end 372 of the split tube includes cam follower portions 376 that are thin near the end 372 and becoming thicker away from the end 372. Bolt 380 having head 382 and threaded portion 384 passes through the hole 360 and extends into the split tube. The head of the bolt is entirely accommodated within the bore 362 such that the head does not protrude beyond the bottom surface of base.

Cam member 390, having cam surfaces 391 that are complimentary to cam follower portions 376, is seated within the split tube. The cam member includes a bore 394 that receives the bolt, and a hexagonal recess 395 for receiving a conventional threaded nut 397 that receives the threaded portion 384 of the bolt. It is apparent that rotation of the bolt results in the sliding movement of the cam member along the threaded portion of the bolt thereby translating to lateral expansion or contraction of the split tube as a result of the interaction of the cam surface of the cam member and the cam following surfaces of the split tube.

In operation, the bolt 380 passes through the hole 360 from the bottom side of the base and is in communication with the nut 397 within the cam member 390 that is seated within the cam follower portion of the split tube 330, and the thread portion 384 mates with the nut 397. While the split member is in relaxed state, —i.e. when the tension in the bolt 384 is eased off such that the cam member merely rests within the cam follower portion of the split tube 330—the tubular member 320 is fitted over the split tube 330 and into the channel 340. As the bolt 380 is tightened, the cam member 390 is drawn into the split tube 330 causing the cam portions of the cam member act against the cam followers in the split tube, thereby creating lateral leverage forces that drive the split tube against the inner wall of the tubular member to secure the tubular member to the base. The anchoring device is then positioned on the mounting surface and secured thereto with the fasteners. The fastener heads are hidden within counter bores 327 in the top surface of the base. The bottom surface of the post is then prepared as described above and the post is driven onto the anchoring device as described previously herein.

Figure 15:
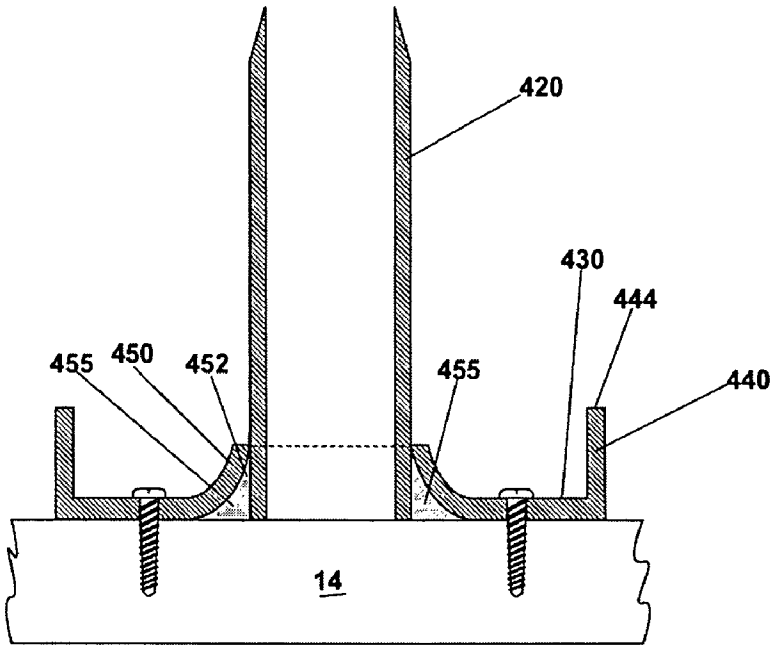
FIG. 15 is a center cross section of the device in FIG. 13.
Figure 14:
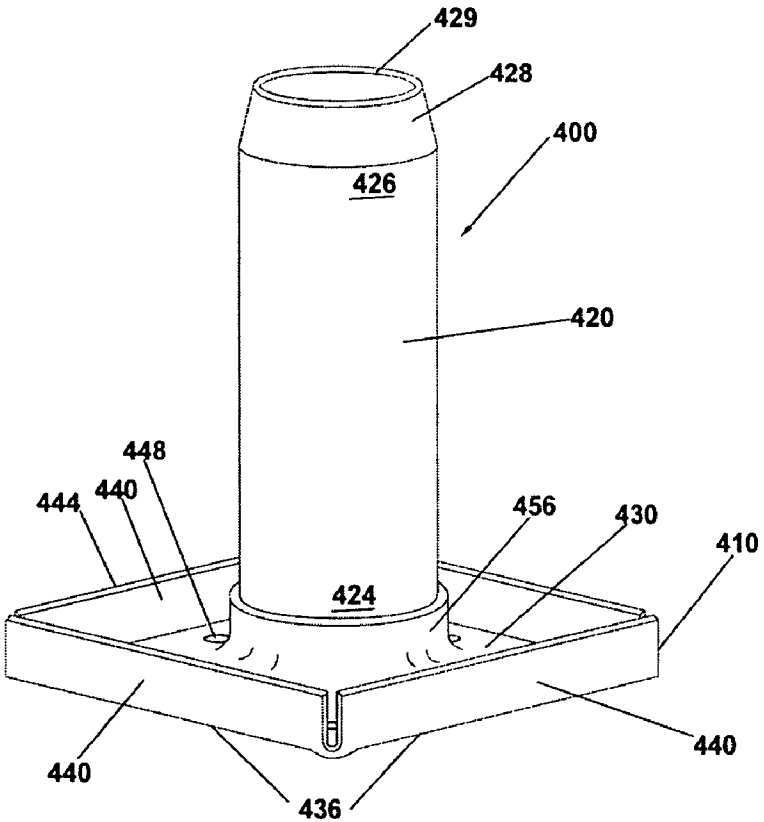
FIG. 14 is a perspective view of a further embodiment of a post anchoring device.

Referring to FIGS. 14 and 15, there is shown another embodiment of a post anchoring device. Device 400 comprises a base member 410 and an elongate tubular member 420 similar to those of embodiment 100 described above. The tubular member is connected at base end 424 to the base member 410. The other or terminal end 426 of the tubular member 420 is remote from the base member and has an exposed edge 428 which is preferably beveled into a cutting edge 429 as described above.

Base member 410 comprises a planar member 430 and a flange portion 440 originating along periphery 436 of the planar member and extending away from the planar member such that when the base member is mounted on the surface, the flange portion extends away from the surface. Flange portion 440 terminates in flange edge 444 which is elevated above the mounting surface when the anchoring device is secured to the mounting surface. The planar member 430 further comprises fastening means such as a plurality of holes 448 disposed proximate to periphery 436 for receiving fasteners such as screws (not shown) there through for the mounting of device 400 to the surface.

To achieve a relatively low cost of manufacture, the base member 410 may be cut or stamped from sheet metal such that the flange portion 440 may be pressed upward to form the solid ridge or flange edge 444 around the periphery of the base.

The method of attaching the tubular member to the base differs from the previous embodiments. A circular opening corresponding in size to the cross-sectional dimension of the tubular member is provided through the center of the base and the material adjacent the hole is then formed upward from the base to create a raised support portion 450 for supporting the terminal end of the tubular member at a location that is higher up the length than a standard butt joint and weld as described in the other embodiments. The tubular member then fits closely through the opening. When viewed from underneath, there results a circumferential gap 452 between the outer walls of the tubular member and the base where the raised support portion bends away from the plane of the planar member 430 of the base. The circumferential gap 452 is then filled with welding material 455 so that the base and tubular member are welded together from the underside.

The method results in a very clean looking and strong union as a result of the extra thickness of metal surrounding the joint. This extra strength is precisely where the force of the attached post would be directed. This embodiment would be used in a similar manner as described above for embodiments 10 and 100.

As will be apparent to those skilled in the art various modifications and adaptations are possible in the practice of this invention without departing from the spirit or scope thereof. Accordingly, the scope of the invention is to be construed in accordance with the substance defined by the following claims.

The invention claimed is:

1. A method of anchoring a post to a flat solid surface in floor, patio, deck, railing or balcony applications, the method comprising the steps of:

providing an apparatus comprising a base member adapted to being attached to the surface and a tubular member that defines an inside surface, an outside surface and has a base end and a terminal end, and is at least twice as long as it is wide, wherein the base end of the tubular member is connected to the base member and the terminal end is remote from the base member, and the terminal end defines an edge capable of piercing into the post; and carrying out steps (a) and (b) in any order:

(a) attaching the base member of the apparatus to the surface at a location where the post is to be located;

(b) longitudinally aligning the post with the tubular member, abutting an end of the post to the terminal end and forcing the tubular member into the post to substantially impale the post in a manner that all of the outside surface and all of the inside surface of the tubular member that is within a space defined by the external boundaries of the post are in frictional engagement with the material of the post to secure the tubular member to the post.

2. The method of claim 1 further comprising selecting the tubular member and the post such that the ratio of the width or diameter of the post to the length of the tubular member is in the range of approximately 0.8:1 to 1.5:1 and the ratio of the width or diameter of the post to the diameter of the tubular member is in the range of approximately 2.4:1 to 5.5:1.

3. The method of claim 1 further comprising selecting the tubular member and the post such that the ratio of the width or diameter of the post to the length of the tubular member is approximately 1:1 and the ratio of the width or diameter of the post to the diameter of the tubular member is approximately 3.5:1.

4. A method of anchoring a post to a flat solid surface in floor, patio, deck, railing or balcony applications, the method comprising the steps of:

providing an apparatus comprising a base member adapted to of being attached to the surface and a tubular member that defines an inside surface, an outside surface and has a base end and a terminal end, and is at least twice as long as it is wide, wherein the base end of the tubular member is connected to the base member and the terminal end is remote from the base member, and the terminal end defines an edge capable of piercing into the post;

providing a longitudinal cavity in one end of the post to accommodate the tubular member for a close frictional fit therein, the cavity having a depth that is less than the length of the tubular member;

driving the post over the tubular member until the terminal end of the tubular member abuts the end of the cavity; and forcing the post onto the tubular member so that the tubular member substantially impales the post in a manner that all of the outside surface of the tubular member that is within a space defined by the external boundaries of the post, and a portion of the inside surface of the tubular member, are in frictional engagement with the material of the post to secure the tubular member to the post.

5. The method as claimed in claim 4 wherein the depth of the cavity is less than an intended penetration depth of the tubular member into the post.

6. The method as claimed in claim 5 wherein the depth of the cavity is not greater than two-thirds of the length of the tubular member.

7. A method of anchoring a post to a flat solid surface in floor, patio, deck, railing or balcony applications, the method comprising the steps of:

providing an apparatus comprising a base member adapted to of being attached to the surface and a tubular member that defines an inside surface, an outside surface and has a base end and a terminal end, and is at least twice as long as it is wide, wherein the base end of the tubular member is connected to the base member and the terminal end is remote from the base member, and the terminal end defines an edge capable of piercing into the post;

providing a circular cut of the same diameter as the tubular member in one end of the post to accommodate the tubular member therein, the circular cut having a depth that is less than the length of the tubular member; and carrying out steps (a) and (b) in any order:

(a) attaching the base member of the apparatus to the surface at a location where the post is to be located;

(b) aligning the circular cut of the post with the tubular member and sliding the post over the tubular member until the terminal end of the tubular member abuts the end of the circular cut, and then forcing the tubular member further into post to substantially impale the post in a manner that all of the outside surface of the tubular member that is within the post, and a portion of the inside surface of the tubular member, are in frictional engagement with the material of the post to secure the tubular member to the post.

8. The method of claim 7 further comprising selecting the tubular member and the post such that the ratio of the width or diameter of the post to the length of the tubular member is in the range of approximately 0.8:1 to 1.5:1 and the ratio of the width or diameter of the post to the diameter of the tubular member is in the range of approximately 2.4:1 to 5.5:1.

9. The method of claim 7 further comprising selecting the tubular member and the post such that the ratio of the width or diameter of the post to the length of the tubular member is approximately 1:1 and the ratio of the width or diameter of the post to the diameter of the tubular member is approximately 3.5:1.

10. The method of claim 7 wherein the depth of the circular cut is less than an intended penetration depth of the tubular member into the post.

11. The method of claim 10 wherein the depth of the circular cut is not greater than two-thirds of the length of the tubular member.

* * * * *